US006004014A

United States Patent [19]

Yamamura et al.

[11] Patent Number: 6,004,014

[45] Date of Patent: Dec. 21, 1999

[54] VEHICLE HEADLAMP WITH STEPS IN PERIPHERY WITH PARABOLIC EDGES WITH DIFFERENT FOCAL LENGTHS

[75] Inventors: Satoshi Yamamura; Naoki Uchida, both of Shizuoka, Japan

[73] Assignee: Koito Manufacturing Co., Ltd., Tokyo, Japan

[21] Appl. No.: 08/895,990

[22] Filed: Jul. 17, 1997

[30] Foreign Application Priority Data

Jul. 18, 1996 [JP] Japan ..... 8-207968

[51] Int. Cl.[6] ..... F21V 7/09

[52] U.S. Cl. ..... 362/518; 362/346

[58] Field of Search ..... 362/507, 516, 362/518, 346

[56] References Cited

U.S. PATENT DOCUMENTS 5,171,082 12/1992 Watanable ..... 362/518
5,299,101 3/1994 Serizawa ..... 362/61
5,416,671 5/1995 Uchida ..... 362/61
5,539,629 7/1996 Chinniah ..... 362/518
5,562,342 10/1996 Nino ..... 362/518

*Primary Examiner*—Sandra O'Shea
*Assistant Examiner*—Marshall Honeyman
*Attorney, Agent, or Firm*—Sughrue, Mion, Zinn, Macpeak & Seas, PLLC

[57] ABSTRACT

A vehicle headlamp comprises: a discharge bulb; and a reflector having a reflecting surface including a plurality of reflecting surface elements to reflect the output light of the discharge bulb forwardly, wherein an sub light distribution pattern having an oblique cut line and a horizontal cut light is formed by controlling light reflected from the reflecting surface elements. Of the plurality of reflecting surface elements, oblique cut line forming reflecting surface elements, and horizontal cut line forming reflecting surface elements extend above the lines of intersection between the reflecting surface and an inclined surface which passes through the optical axis of the reflector and has an angle of elevation of 15°.

18 Claims, 7 Drawing Sheets

VEHICLE HEADLAMP WITH STEPS IN PERIPHERY WITH PARABOLIC EDGES WITH DIFFERENT FOCAL LENGTHS

BACKGROUND OF THE INVENTION

This invention relates to a vehicle headlamp with a discharge bulb, and more particularly to a sub light distribution pattern forming headlamp.

A discharge bulb is able to perform high brightness irradiation. Hence, recently, it has been employed as the light source of a vehicle headlamp.

In the case where, in such a headlamp with a discharge bulb, a sub light distribution pattern having oblique and horizontal cut lines is formed, the sub light distribution pattern is high in the recognition of far objects, and large in the angle of irradiation.

A headlamp has been proposed in the art which uses a reflector having a reflecting surface including a plurality of reflecting surface elements to reflect the output light of a discharge lamp, thereby to form the aforementioned sub light distribution pattern.

In the case where, as was described above, the reflecting surface of the reflector is made up of a plurality of reflecting surface elements, generally not only a border line which divides the reflecting surface elements into right and left parts but also a border line which divide the reflecting surface elements into upper and lower parts is formed on the reflecting surface.

However, in the case where the border line which divides the reflecting surface elements into upper and lower parts (hereinafter referred to as "an upper and lower border line", when applicable) is carelessly formed on the reflecting surface of the reflector, the following problems are involved:

That is, in the case where, as shown in FIG. 8, the upper and lower border line L is present on the reflecting surface 22 of the reflector 16, the reflecting surface 22 is discontinuous at the upper and lower border line L, and therefore the undercoating paint applied to the reflecting surface 22 for aluminum vacuum deposit treatment forms a paint pool B near the upper and lower boarder line L. This paint pool B is formed not only in the case where, as shown in FIG. 8(*a*), the upper and lower border line L is of a downward step, but also in the case where, as shown in FIG. 8(*b*), the upper and lower boarder line L is of an upward step, and in the case where, as shown in FIG. 8(*c*), the border line L is of a protrusion. And the output light of the discharge bulb 18 applied to the aforementioned paint pool B is reflected in a direction which is different from the aimed direction, to form an upward diffused light Ru, thus glaring on the driver on an oncoming car.

In the case of a conventional headlamp whose light source is a halogen bulb or the like, the upward diffused light from the upper and lower border line causes no serious problem in practical use; however, in the case of a head lamp whose light source is a discharge bulb, the upward diffused light cannot be disregarded because the power of the light source is considerably great.

SUMMARY OF THE INVENTION

In view of the foregoing, an object of the invention is to provide a sub light distribution pattern forming vehicle headlamp which is so designed that the output light of the discharge lamp is controlled by a plurality of reflecting surface elements forming the reflecting surface of the reflector, in which the glare due to the upward diffused light from the upper and lower border line on the reflecting surface is decreased.

According to a first aspect of the invention, there is provided a vehicle headlamp which comprises: a discharge bulb; and a reflector having a reflecting surface including a plurality of reflecting surface elements to reflect the output light of the discharge bulb forwardly, wherein an sub light distribution pattern having an oblique cut line and a horizontal cut light is formed by controlling light reflected from the reflecting surface elements. Of the plurality of reflecting surface elements, oblique cut line forming reflecting surface elements, and horizontal cut line forming reflecting surface elements extend above the lines of intersection between the reflecting surface and an inclined surface which passes through the optical axis of the reflector and has an angle of elevation of 15°.

According to a second aspect of the invention, there is provided a vehicle headlamp which comprises: a discharge bulb; and a reflector having a reflecting including a plurality of reflecting surface elements to reflect the output light of the discharge bulb forwardly, wherein an sub light distribution pattern having an oblique cut line and a horizontal cut light is formed by controlling light reflected from the reflecting surface elements. Of the plurality of reflecting surface elements, oblique cut line forming reflecting surface elements, and horizontal cut line forming reflecting surface elements extend above the lines of intersection between the reflecting surface and a horizontal surface which lies 15 mm above the optical axis of the reflector.

According to a third aspect of the invention, there is provided the vehicle headlamp according to either first or second aspect, wherein each of the oblique cut line forming reflecting elements comprises: a lower region extending in a first predetermined angle with respect to a vertical direction; and an upper prolongation region extending in a second predetermined angle with respect to the vertical direction which is smaller than the first predetermined angle, and an oblique distribution pattern is formed along the oblique cut line by light reflected from the lower regions, while a substantially horizontal distribution pattern is formed by light reflected from the upper prolongation regions in such a manner that the substantially horizontal distribution pattern is located below the oblique distribution pattern, and extending substantially horizontally.

According to a fourth aspect of the invention, there is provided the vehicle headlamp according to the third aspect, wherein an intermediate region is provided between each of the lower regions and each of the upper prolongation regions so as to form an intermediate distribution pattern between the oblique distribution pattern and the substantially horizontal distribution pattern.

According to a fifth aspects, there is provided the vehicle headlamp according to the fourth aspect, wherein the diffusion deflection angle of light reflected from each of the intermediate regions is so selected as to be gradually changed from the diffusion deflection angle of light reflected from the lower region thereof to the diffusion deflection angle of light reflected from the upper prolongation region thereof.

According to a sixth aspect, there is provided the vehicle headlamp according to the fifth aspect, wherein the left edges of each of the lower regions and of each of the upper prolongation regions are of a parabola having a focal length f1, while right edges thereof are of a parabola having a focal length f2, and the left edge of each of the intermediate regions is of the parabola having the focal length f1, while right edge thereof is of the parabola having the focal length f2.

In general, as shown in FIG. 9, in a sub light distribution pattern P, a distribution pattern PA' and a distribution pattern PB' which form an oblique cut line CL1 and a horizontal cut line CL2, respectively, are formed by light reflected from regions 22A' and 22B' (indicated by the oblique lines in FIG. 9) of the reflecting surface 22 of a reflector. If the above-described upper and lower border line is present in the region 22A' or 22B' or near above the latter, the light diffused upwardly from the paint pool is applied, as relatively brightly light, to regions above the cut lines CL1 and CL2, which glares on the driver in the oncoming vehicle.

On the other hand, in the vehicle headlamp of the invention, no upper and lower border line is present in the region containing the reflecting surface elements, oblique cut line forming reflecting surface elements, and horizontal cut line forming reflecting surface elements extending above the lines of intersection between the reflecting surface and an inclined surface which passes through the optical axis of the reflector and has an angle of elevation of 15°. Hence, the paint pool is scarcely formed which may form the upward diffused light which is applied to the regions above the cut lines.

The reason for the setting of the angle of elevation to 15° is as follows: First, the employment of an angle of elevation is based on the following reason: That is, in the reflecting surface regions on the right and left sides of the optical axis of the reflector, an image is formed near the cut line in the upper region which is far from the optical axis. The setting of the angle of elevation to 15° is because, in the case where the upper and lower border line is present, the region which may be irradiated by the bright upward diffused light is included in a range less than 15°.

In the vehicle headlamp of the second aspect, oblique cut line forming reflecting surface elements, and horizontal cut line forming reflecting surface elements are extended above the lines of intersection between the reflecting surface and a horizontal surface which lies 15 mm above the optical axis of the reflector. In this region, no upper and lower border line is present. Hence, the paint pool is scarcely formed which may form the upward diffused light which is applied, as relatively bright light, to the regions above the cut lines.

The use of the words "above 15 mm above the optical axis" is based on the following reason: Originally, similarly as in the first aspect, it should be "an angle of elevation of 15°". However, in a sub light flux distribution pattern forming vehicle headlamp, the width dimension (in a right-to-left direction) is, in general, not so large. Hence, even if the height (position) is employed instead of the angle of elevation, substantially one and the same region can be approximately selected. In this case, even if the words "15 mm above" is employed for the definition of the height (position), its effect is the same as in the case where the words "angle of elevation of 15°" is employed.

Hence, in the sub light distribution pattern forming vehicle headlamp which is so designed that the output light of the discharge bulb is controlled by a plurality of reflecting surface elements forming the reflector reflecting surface, the formation of glare, which is due to the upward diffused light from the upper and lower border line on the reflecting surface, can be decreased.

The above-described oblique cut line forming reflecting elements may be each straightly extended forming a predetermined angle with a vertical direction so that the light reflected therefrom forms an oblique distribution pattern along the oblique cut line. However, according to the third aspect, each of the oblique cut line forming reflecting elements may comprise; a lower region which is extended forming a first predetermined angle with a vertical direction; and an upper prolongation region extending from a second predetermined angle with the vertical direction which is smaller than the first predetermined angle, so that an oblique distribution pattern is formed along the oblique cut line by light reflected from the lower regions, while a substantially horizontal distribution pattern is formed by light reflected from the upper prolongation regions in such a manner that the substantially horizontal distribution pattern is located below the oblique distribution pattern, and extended substantially horizontally. In this case, the difficulty is eliminated that only the oblique distribution pattern becomes extremely bright, and the oblique distribution pattern can irradiate the shoulder of the road on the side of the vehicle. Thus, the sub light distribution pattern is improved.

In this connection, according to the fourth aspect, an intermediate region may be provided between each of the lower regions and each of the upper prolongation regions so as to form an intermediate distribution pattern between the oblique distribution pattern and the substantially horizontal distribution pattern. In this case, the oblique distribution pattern, and the substantially horizontal distribution pattern are maintained high in continuity. Hence, the resultant sub light distribution pattern is substantially uniform in the distribution of light.

On the other hand, if, even in the case where each of the oblique cut line forming reflecting surface elements is not linear, it is equal in the diffusion deflection angle of light reflected therefrom, no border line is formed between the lower region and the upper prolongation region. However, in order to improve the sub light flux distribution pattern, it is necessary that the oblique flux distribution pattern is different from the substantially horizontal flux distribution pattern in diffusion deflection angle. (Generally, it is desirable that the diffusion angle of the substantially horizontal flux distribution pattern is larger than that of the oblique flux distribution pattern.)

In this case, according to the fifth aspect, the intermediate region is formed between the lower region and the upper prolongation region of each of the oblique cut line forming reflecting surface elements, and the diffusion deflection angle of light reflected from each of the intermediate regions is so selected as to be gradually changed from the diffusion deflection angle of light reflected from the lower region thereof to the diffusion deflection angle of light reflected from the upper prolongation region thereof. This feature prevents the formation of the border line between the lower region and the upper prolongation region even if the oblique distribution pattern is different from the substantially horizontal distribution pattern in the diffusion deflection angle. The continuity of the oblique distribution pattern and the substantially horizontal distribution pattern with the aid of the intermediate distribution pattern is improved more. Thus, the resultant sub light distribution pattern is more uniform in the distribution of light.

More specifically, the oblique cut line forming reflecting surface elements is designed according to the sixth aspect; that is, the left edges of each of the lower regions and of each of the upper prolongation regions are of a parabola having a focal length f1, while right edges thereof are of a parabola having a focal length f2, and the left edge of the intermediate region is of the aforementioned parabola having the focal length f1, while right edge thereof is of the aforementioned parabola having the focal length f2.

DETAILED DESCRIPTION OF THE PREFERRED EMBODIMENTS

A preferred embodiment of the invention will be described with reference to the accompanying drawings.

Figure 1:
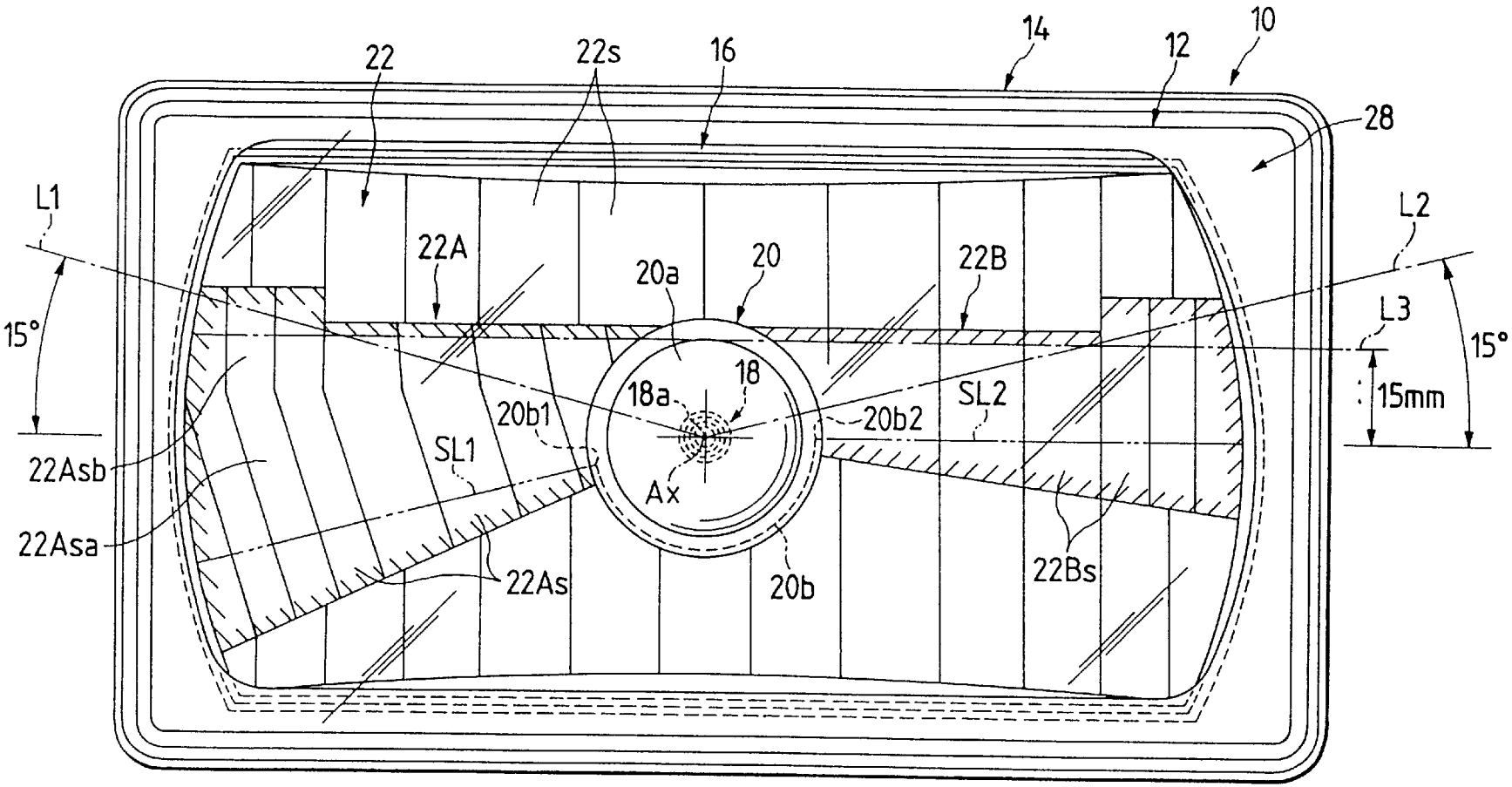
FIG. 1 is a front view of a vehicle headlamp according to the invention.
Figure 2:
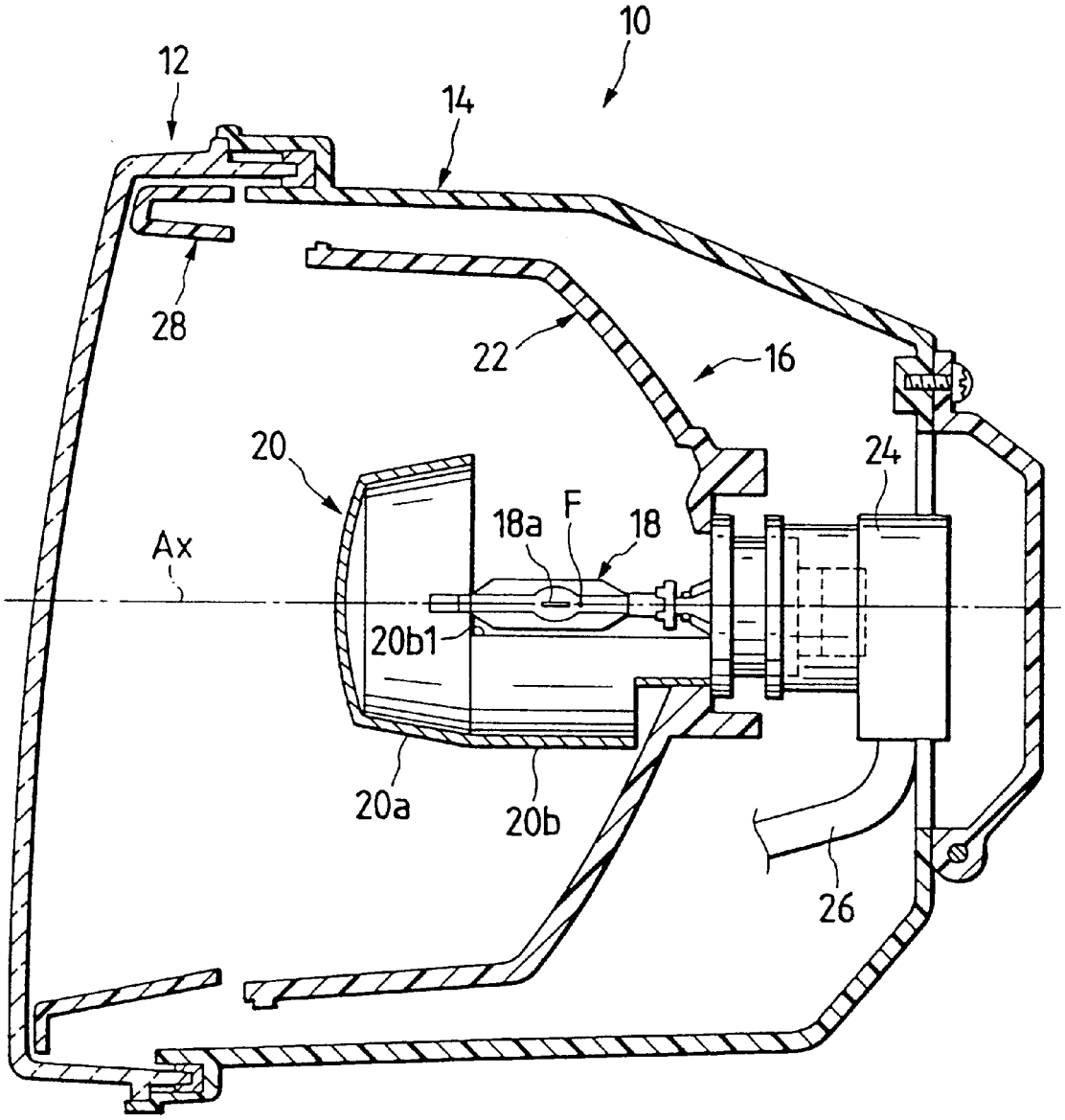
FIG. 2 is a sectional side view of the vehicle head lamp shown in FIG. 1.

FIG. 1 is a front view of a vehicle headlamp, which is the embodiment of the invention, and FIG. 2 is a sectional side view of the vehicle headlamp.

Figure 3A:
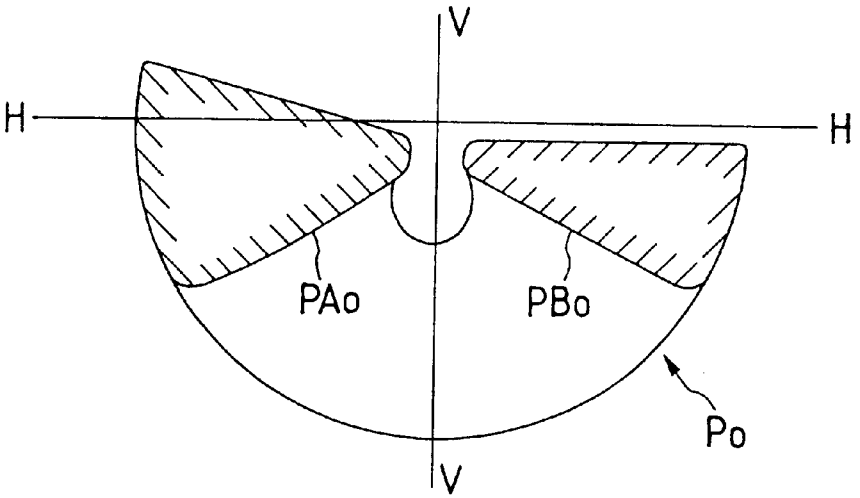
FIGS. 3(*a*) and 3(*b*) are diagram showing a screen distribution pattern for a description of the function of the aforementioned embodiment of the invention.
Figure 3B:
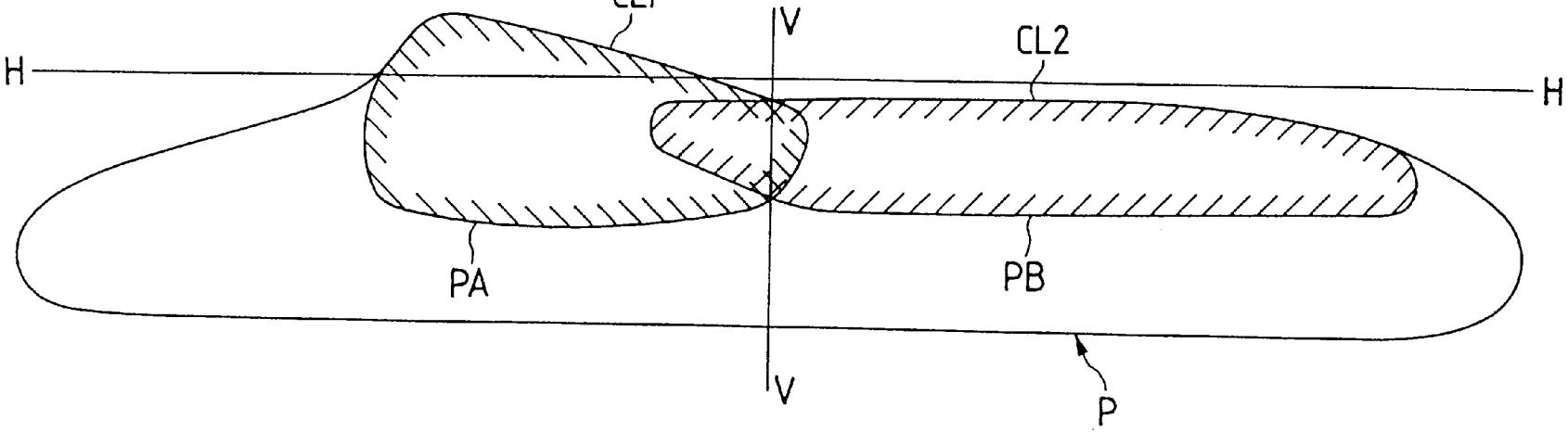

As shown in FIGS. 1 and 2, in the headlamp 10 of the invention, a reflector 16 with a discharge bulb 18 and a shade 20 is vertically and horizontally tiltably mounted in a space which is defined by a lens 12 and a body 14. The headlamp 10 is so designed that, as shown in FIG. 3(*b*), it forms a sub light distribution pattern P of left distribution type having an oblique cut line (15° cut line) CL1 and a horizontal cut line CL2.

The aforementioned lens is plain lens, and the aforementioned sub light distribution pattern P is formed by the reflector 16.

That is, the reflecting surface 22 of the reflector 16 is designed as follows: The paraboloid of revolution whose central axis is the optical axis Ax extended in a front-to-rear direction is employed as a reference surface. The reference surface is divided into a plurality of segments, and reflecting surface elements 22*s*, which are different in curvature from the reference surface, are assigned to those segments. And the curvatures of the reflecting surface elements 22*s* are set to suitable values, so that, with a distribution pattern Po (as shown in FIG. 3(*a*)) as a reference which is formed by the light reflected from the above-described reference surface, the sub light distribution pattern P as shown in FIG. 3(*b*) is obtained.

The aforementioned discharge bulb 18 is a metal halide discharge bulb. It is mounted on the reflector 16 in such a manner that its optical axis is the same as the optical axis Ax of the reflector 16, and its light emitting section (arc generating section) 18*a* is located slightly in front of the focal position F of the paraboloid of revolution which is the reference surface of the reflector 16. The discharge bulb 18 is turned on by high voltage. Hence, the discharge bulb 18 is connected through a bulb socket 24 and a high voltage cord 26 to a high voltage source (not shown). An extension 28 is provided in front of the reflector 16.

The aforementioned shade 20 comprises: a cup-shaped front end portion 20*a* which covers the front of the discharge bulb 18; and a half-cylinder-shaped portion 20*b*. The half-cylinder-shaped portion 20*b* extends backwardly from the front end portion 20*a* in such a manner that it substantially covers the lower half of the discharge bulb 18, and its rear end is secured to the reflector 16. The front end portion 20*a* intercepts light emitted directly from the discharge bulb 18 towards the front of the headlamp, while the half-cylinder-shaped portion 20*b* intercepts light emitted from the discharge bulb 18 towards the lower region of the reflecting surface 22 of the reflector. The aforementioned oblique cut line CL1 is formed by the right (as viewed in the forward direction of the headlamp) upper end edge 20*b*1 of the half-cylindrical, while the aforementioned horizontal cut line CL2 is formed by the left (as viewed in the forward direction of the headlamp) upper end edge 20*b*2.

As indicated by the two-dot chain lines in FIG. 1, on the reflecting surface 22 of the reflector 16, the above-described right upper end edge 20*b*1 and left upper end edge 20*b*2 form the shade lines SL1 and SL2 of the light from the light. emitting section 18*a* of the discharge bulb 18.

In FIG. 1, the reflecting surface elements 22A*s* forming reflecting surface region 22A (indicated by the left-upward oblique lines) extend vertically in such a manner that they are inclined 15° to the left with respect to the vertical line so as to be perpendicular to the shade line SL1. The collection of the light beams reflected from those reflecting surface elements 22A*s*, forms a distribution pattern PA having the oblique cut line CL1 as shown in FIG. 3(*b*). Those oblique cut line forming reflecting surface elements, namely, the reflecting surface elements 22A*s*, extend above the line of intersection L1 of the reflecting surface 22 and the inclined surface which goes through the optical axis Ax of the reflector 16 and has an angle of elevation of 15°. In this case, the upper prolongation region 22A*sb* of each of the reflecting surface elements 2A*s* is smaller in the angle of left inclination than its lower region 22A*sa*, or its angle of left inclination is set to zero; however, it should be noted that the upper prolongation regions 22A*sb* and the lower regions 22A*sa* form a continuous surface.

On the other hand, in FIG. 1, the reflecting surface elements 22B*s* forming reflecting surface region 22B (indicated by the right-upward oblique lines) extend straightly vertically in such a manner that they are perpendicular to the shade line SL2 . The collection of the light beams reflected from those reflecting surface elements 22B*s*, forms a distribution pattern PB having the horizontal cut line CL2 as shown in FIG. 3(*b*). Those horizontal cut line forming reflecting surface elements, namely, the reflecting surface elements 22B*s*, extend above the line of intersection L2 of the reflecting surface 22 and the inclined surface which goes through the optical axis Ax of the reflector 16 and has an angle of elevation of 15°. In each of the reflecting surface elements 22A*s*, its upper elongation region and its lower region form a continuous surface.

In FIG. 3(*a*), distribution patterns PAo and PBo are those which are formed by light beams reflected from the reflecting surface regions 22A and 22B under the condition that the above-described reflecting surface 22 is of the above-described reference surface.

Now, the function of the above-described embodiment will be described.

In the case where, in the reflecting surface 22 of the reflector 16, an upper and lower border line is present in the reflecting surface regions on the right and left sides of the optical axis Ax of the reflector 16, the light beam diffused upwardly from the paint pool formed on the upper and lower border line is applied, as a relatively bright light beam, to the regions above the aforementioned cut lines CL1 and CL2, thus glaring on the driver on an oncoming car. However, in the embodiment, the reflecting surface elements 22A*s* and 22B*s* of the reflecting surface regions forming the cut lines CL1 and CL2 are extended above the lines of intersections L1 and L2 of the reflecting surface 22 and the inclined surfaces which passes through the optical axis Ax forming the angle of elevation of 15°, and no upper and lower border line is present in the reflecting surface regions on the right and left sides of the optical axis Ax of the reflector, and therefore the paint pool will never be formed which is a cause for the formation of the diffused light beam.

Thus, in the embodiment of the invention, in the sub light distribution pattern forming vehicle headlamp which is so designed that a plurality of reflecting surface elements forming the reflector reflecting surface control light from the discharge lamp, the glaring light is decreased which is due to the upwardly diffused light from the upper and lower border line on the above-described reflecting surface.

In the above-described embodiment, in order that the upper and lower boarder line is not formed in the reflecting surfaces region on the right and left side of the optical axis Ax of the reflector, the reflecting surfaces elements 22A*x* and 22B*s* extend above the lines of intersection L1 and L2 of the reflecting surface 22 and the inclined surface which passes through the optical axis Ax of the reflector 16 forming the angle of elevation of 15°. However, as shown in FIG. 1, the reflecting surfaces elements 22A*s* and 22B*s* extend above the horizontal surface which is 15 mm above the optical axis Ax of the reflector 16. Therefore, the glaring light is more effectively decreased which is due to the upwardly diffused light from the paint pool.

If, in the case where the reflecting surface elements 22A*s* and 22B*s* are extended above the line of intersection L3 only, but they are not extended above the lines of intersections L1 and L2, the right and left dimensions of the reflector 16 are as shown in FIG. 1, the glaring light which is due to the upwardly diffused light from the paint pool can be decreased similarly as in the case where the reflecting surface elements 22A*s* and 22B*s* extend above the lines of intersections L1 and L2 only.

Now, a first modification of the embodiment according to the invention will be described.

Figure 4:
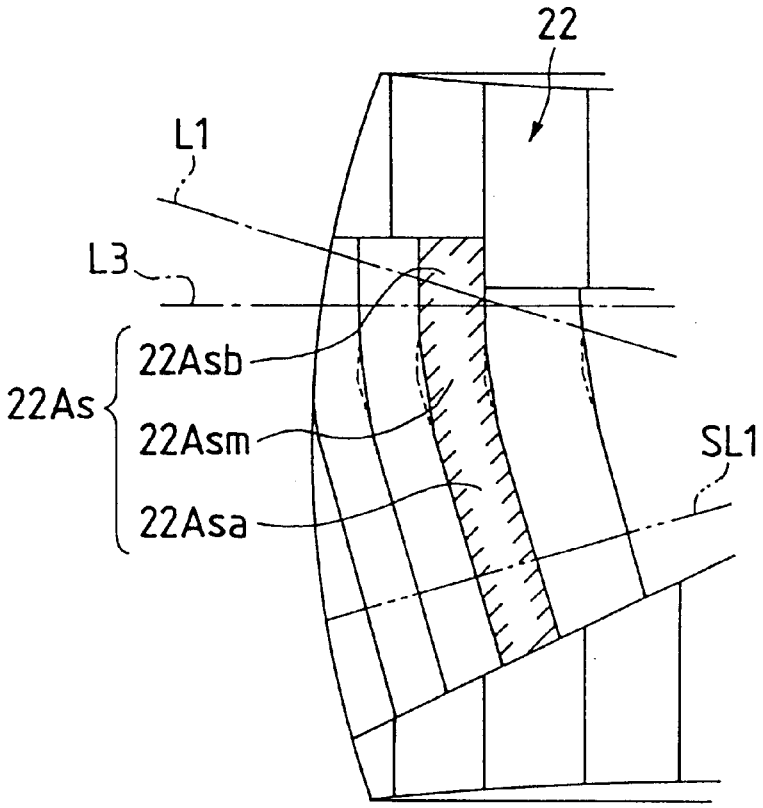
FIG. 4 is a front view of essential parts of a reflecting surface, for a description of a first modification of the embodiment according to the invention.

FIG. 4 shows the first modification; more specifically, FIG. 4 is a front view of essential parts of a reflecting surface 22.

In the above-described embodiment, as indicated by the broken lines in FIG. 4, the oblique cut line forming reflecting surfaces elements 22A*s* are each extended upwardly in such a manner that the upper prolongation region 22A*sb* bends at the upper end of the lower region 22A*sa*; however, in the modification, the lower region 22A*sa* and the upper prolongation region 22A*sb* has an arcuate intermediate region 22A*sm* between them, so that the lower region 22A*sa* is smoothly connected to the upper prolongation region 22A*sb* through the intermediate region 22A*sm*. In the modification, those regions, namely, the lower region 22A*sa*, the intermediate region 22A*sm*, and the upper prolongation region 22A*sb* are equal in section to one another, and accordingly the light beams reflected therefrom are equal in diffused deflection angle to one another.

The function of the above-described modification will be described.

Figure 5:
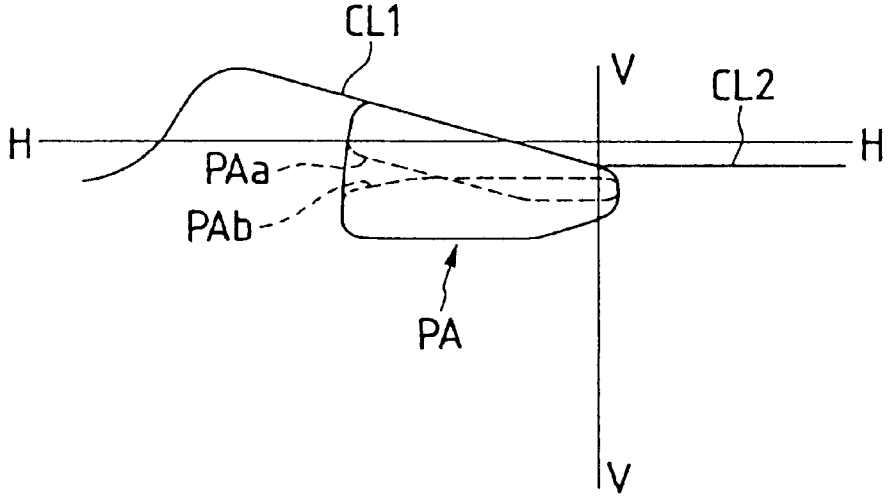
FIG. 5 is a diagram showing a screen distribution pattern for a description of the function of the aforementioned first modification.

For convenience in description, let us consider one oblique cut line forming reflecting element 22A*s* (indicated by the oblique line in FIG. 4). In this case, the distribution pattern PA formed by the light reflected from the reflecting element 22A*s* is as shown in FIG. 5.

In the above-described embodiment, as indicated by the broken line, the light reflected from the lower region 22A forms an oblique distribution pattern PAa along the oblique cut line CL1, and the light reflected from the upper prolongation region 22A*sb* form a substantially horizontal distribution pattern PAb which is extended substantially horizontally below the oblique distribution pattern PAa. This feature eliminates the difficulty that only the oblique distribution pattern PAb is high in brightness more than required, and the substantially horizontal distribution pattern PAb irradiates a shoulder off the road; that is, in this case, the sub light distribution pattern P is more preferable in practical use. However, as is seen from FIG. 5, the left end portions of the oblique distribution pattern PAa and of the substantially horizontal distribution pattern PAb are away from each other, thus forming a dark region.

On the other hand, in the modification, the intermediate region 22A*sm* is provided between the lower region 22A*sa* and the upper prolongation region 22A*sb*. This feature forms an intermediate distribution pattern between the oblique distribution pattern PAb and the substantially horizontal distribution pattern PAb in such a manner that the patterns PAa and PAb are made continuous to each other through the intermediate distribution pattern. Hence, as indicated by the solid line in FIG. 5, a distribution pattern PA having no dark region is obtained. That is, the resultant sub light distribution pattern is more uniform in the distribution of light.

Now, a second modification of the embodiment according to the invention will be described.

Figure 6:
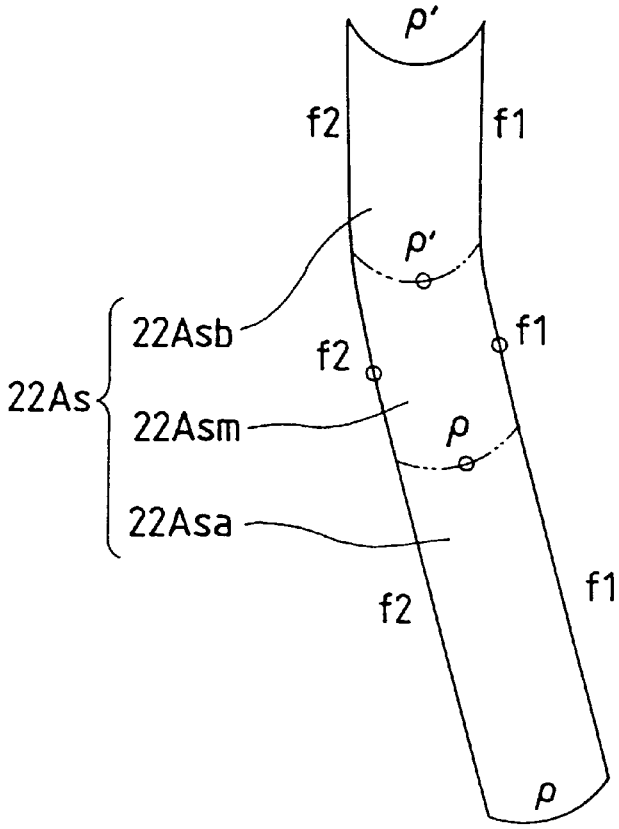
FIG. 6 is a perspective view of an oblique cut line forming reflecting surface element for a description of the second modification of the embodiment according to the invention.

FIG. 6 is a perspective view of one oblique cut line forming reflecting surface element 22A*s*.

As shown in FIG. 6, the lower region 22A*sa* and the upper prolongation region 22A*sb* of the oblique cut line forming reflecting surface element 22A*s* are different in section, and the lower region 22A*sa* is smoothly connected to the upper prolongation region 22A*sb* through an intermediate region 22A*sm*.

That is, as shown in FIG. 6, the left edges of the lower region 22A*sa* and the upper prolongation region 22A*sb* are each a parabola having a focal length of f1, and the right edges of them are each a parabola having a focal length of f2; and the section of the lower region 22A*sa* is a curve having a relatively small curvature ρ, while the section of the upper prolongation region 22A*sb* is a curve having a relatively large curvature ρ'. If the lower region 22A*sa* and the upper prolongation region 22A*sb* are directly connected to each other, then a step-shaped border line is formed because of the difference in curvature.

Therefore, in the second modification, an intermediate region 22A*sm* is interposed between the lower region 22A*sa* and the upper prolongation region 22A*sb*. The intermediate region 22A*sm* is defined as follows: the left edge is a parabola having a focal length of f1, the right edge is a parabola having a focal length of f2, the lower edge is a curve having a curvature of ρ, and the upper edge is a curve having a curvature of ρ', whereby the lower region 22A*sa* and the upper prolongation region 22A*sb* are smoothly connected to each other through the intermediate region 22A*sm* thus interposed.

Figure 7:
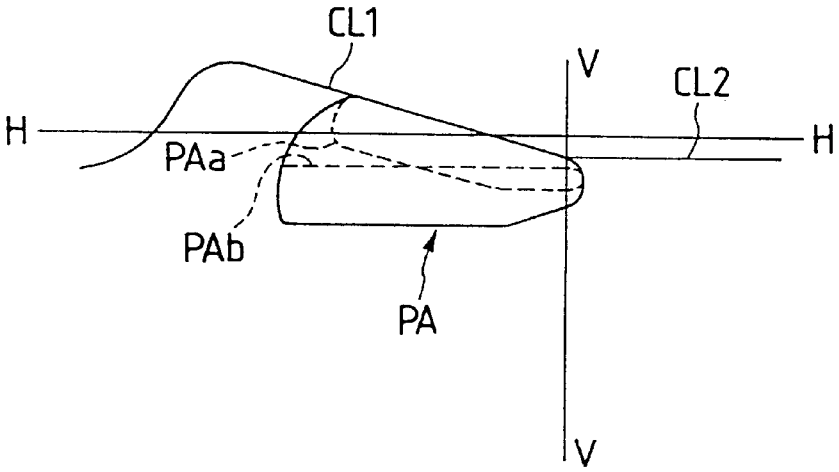
FIG. 7 is a diagram showing a screen distribution pattern, for a description of the function of the second modification.
Figure 8A:
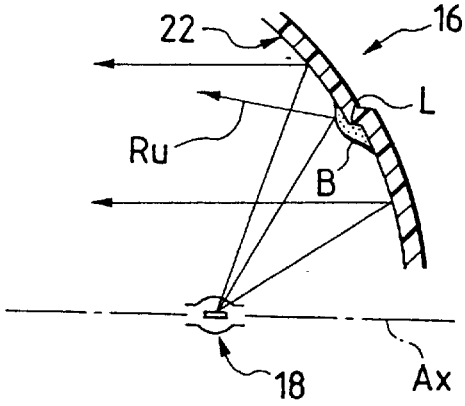
FIGS. 8(*a*) to 8(*c*) are sectional side views showing essential parts of a conventional headlamp, for a description of a function of the latter.
Figure 8B:
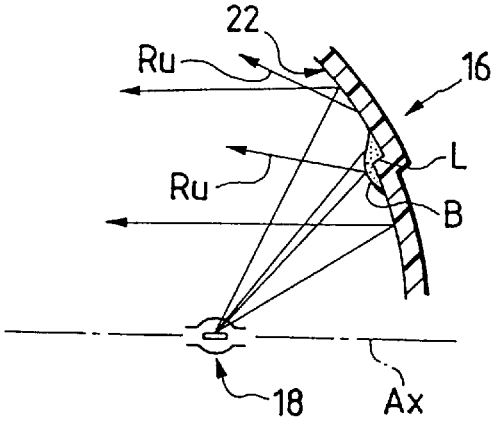
Figure 8C:
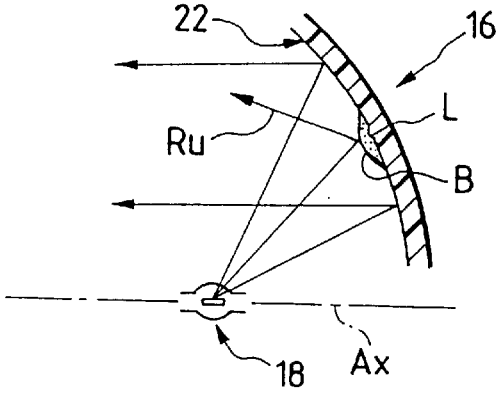
Figure 9:
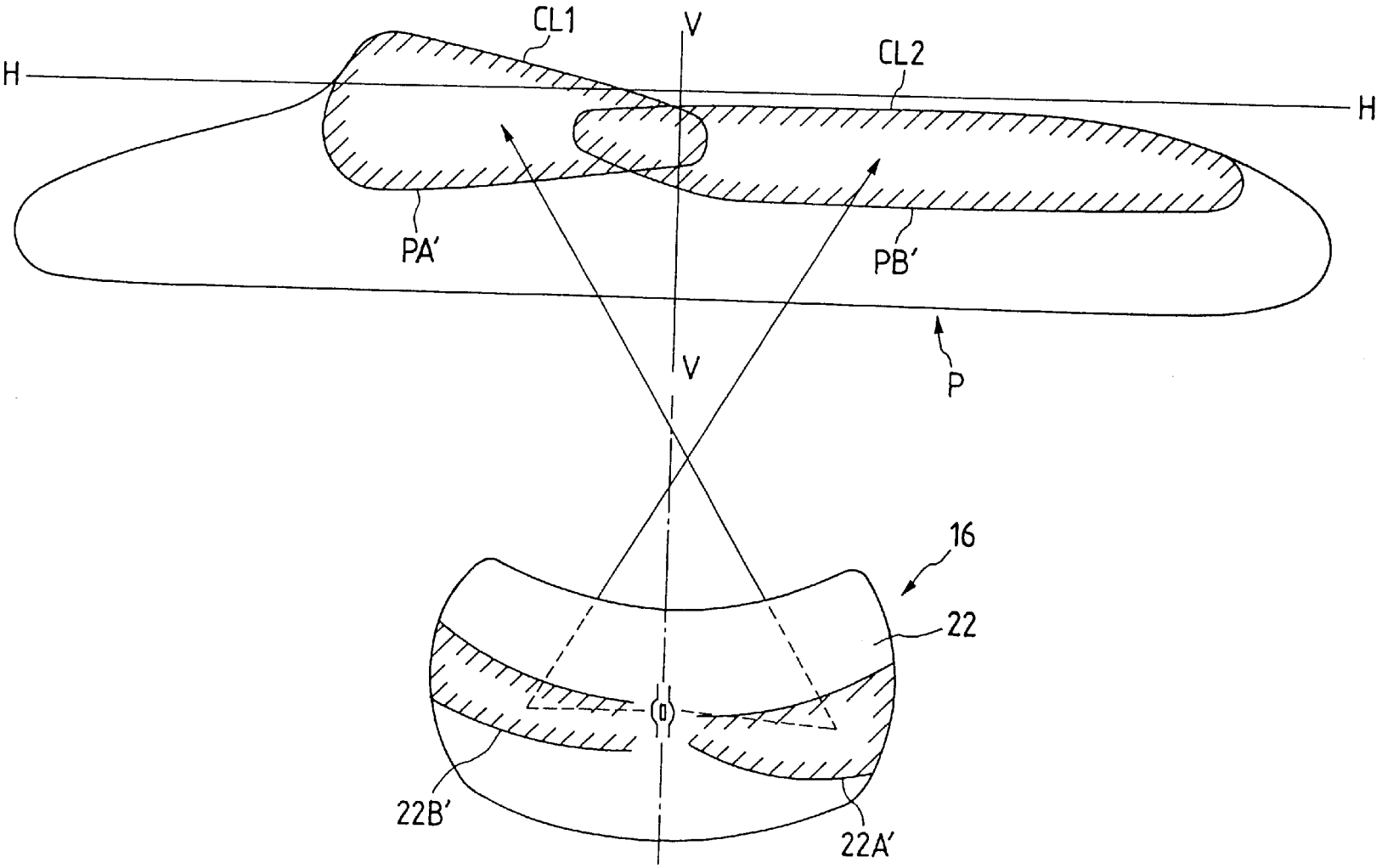
FIG. 9 is a diagram showing a screen distribution pattern, for a description of the function of the headlamp according to the invention.

Because of the above-described difference in curvature, as indicated by the broken lines in FIG. 7, when compared with the oblique distribution pattern PAa formed by light reflected from the lower region 22A*sa*, the substantially horizontal distribution pattern PAb is large in the angle of diffusion; however, the provision of the intermediate region 22A*sm* forms an intermediate distribution pattern between the oblique distribution pattern PAa and the substantially horizontal distribution pattern PAb in such a manner that the pattern PAa is smoothly continued to the pattern PAb through the intermediate distribution pattern thus provided.

As was described, with the modification, even if the oblique distribution pattern and the substantially horizontal distribution pattern are different in diffusion deflection angle, the formation of the border line between the lower region 22A*sa* and the upper prolongation region 22A*sb* is prevented, and the resultant sub light flux distribution pattern is uniform in the distribution of light.

All that is necessary for the above-described intermediate region 22A*sm* is that the right and left edges are the parabola having the focal distances of f1 and f2. If this requirement is satisfied, then it is not always necessary that it is in the form of a segment through which the lower region 22A*sa* and the upper prolongation region 22A*sb* are arcuately connected to each other.

What is claimed is:

1. A vehicle headlamp which comprises: a discharge bulb; a reflector having a reflecting surface including a plurality of reflecting surface elements, including oblique cut line forming reflecting surface elements and horizontal cut line forming reflecting surface elements, to reflect the output light of the discharge bulb forwardly, and a shade positioned about the discharge bulb for selectively directing the output light of the discharge bulb towards the reflecting surface, wherein a sub light distribution pattern having an oblique cut line and a horizontal cut line is formed by the selectively directed output light of the discharge bulb reflected from the reflecting surface elements, wherein each of the oblique cut line forming reflecting elements comprises: a lower region extending in a first predetermined angle with respect to a vertical direction; and an upper prolongation region extending in a second predetermined angle with respect to the vertical direction which is smaller than the first predetermined angle, and the left edges of each of the lower regions and of each of the upper prolongation regions are of a parabola having a focal length f1, while right edges thereof are of a parabola having a focal length f2.

2. The vehicle headlamp according to claim 1, wherein, of the plurality of reflecting surface elements, oblique cut line forming reflecting surface elements, and horizontal cut line forming reflecting surface elements extend above the lines of intersection between the reflecting surface and an inclined surface which passes through the optical axis of the reflector and has an angle of elevation of 15°.

3. The vehicle headlamp as claimed in claim 2, wherein an oblique distribution pattern is formed along the oblique cut line by light reflecte from the lower regions, while a substantially horizontal distribution pattern is formed by light reflected from the upper prolongation regions in such a manner that the substantially horizontal distribution pattern is located below the oblique distribution pattern, and extending substantially horizontally.

4. The vehicle headlamp as claimed in claim 3, wherein an intermediate region is provided between each of the lower regions and each of the upper prolongation regions so as to form an intermediate distribution pattern between the oblique distribution pattern and the substantially horizontal distribution pattern, wherein the left edge of each of the intermediate regions is of the parabola having the focal length f1, while the right edge thereof is of the parabola having the focal length f2.

5. The vehicle headlamp as claimed in claim 4, wherein the diffusion deflection angle of light reflected from each of the intermediate regions is so selected as to be gradually changed from the diffusion deflection angle of light reflected from the lower region thereof to the diffusion deflection angle of light, reflected from the upper prolongation region thereof.

6. The vehicle headlamp according to claim 1, wherein, of the plurality of reflecting surface elements, oblique cut line forming reflecting surface elements, and horizontal cut line forming reflecting surface elements extend above the lines of intersection between the reflecting surface and a horizontal surface which lies 15 mm above the optical axis of the reflector.

7. The vehicle headlamp as claimed in claim 6, wherein an oblique distribution pattern is formed along the oblique cut line by light reflected from the lower regions, while a substantially horizontal distribution pattern is formed by light reflected from the upper prolongation regions in such a manner that the substantially horizontal distribution pattern is located below the oblique distribution pattern, and extending substantially horizontally.

8. The vehicle headlamp as claimed in claim 7, wherein an intermediate region is provided between each of the lower regions and each of the upper prolongation regions so as to form an intermediate distribution pattern between the oblique distribution pattern and the substantially horizontal distribution pattern.

9. The vehicle headlamp as claimed in claim 8, wherein the diffusion deflection angle of light reflected from each of the intermediate regions is so selected as to be gradually changed from the diffusion deflection angle of light reflected from the lower region thereof to the diffusion deflection angle of light reflected from the upper prolongation region thereof.

10. A reflector for a vehicle headlamp, with a discharge bulb and a shade positioned about the discharge bulb for selectively directing the output light of the discharge bulb, having a reflecting surface including oblique cut line forming reflecting surface elements and horizontal cut line forming reflecting surface elements to reflect the selectivity directed output light of the discharge bulb forwardly, wherein a sub light distribution pattern having an oblique cut line and a horizontal cut line is formed by the selectivity directed output light of the discharge bulb reflected from the reflecting surface elements, wherein each of the oblique cut line forming reflecting elements comprises: a lower region extending in a first predetermined angle with respect to a vertical direction; and an upper prolongation region extending in a second predetermined angle with respect to the vertical direction which is smaller than the first predetermined angle, and the left edges of each of the lower regions and of each of the upper prolongation regions are of a parabola having a focal length f1, while right edges thereof are of a parabola having a focal length f2.

11. The reflector according to claim 10, wherein the oblique cut line forming reflecting surface elements and the horizontal cut line forming reflecting surface elements extend above the lines of intersection between the reflecting surface and an inclined surface which passes through the optical axis of the reflector and has an angle of elevation of 15°.

12. The reflector as claimed in claim 11, wherein an oblique distribution pattern is formed along the oblique cut line by light reflected from the lower regions, while a substantially horizontal distribution pattern is formed by light reflected from the upper prolongation regions in such a manner that the substantially horizontal distribution pattern is located below the oblique distribution pattern, and extending substantially horizontally.

13. The reflector as claimed in claim 12, wherein an intermediate region is provided between each of the lower regions and each of the upper prolongation regions so as to form an intermediate distribution pattern between the oblique distribution pattern and the substantially horizontal distribution pattern, wherein the left edge of each of the intermediate regions is of the parabola having the focal length f1, while the right edge thereof is of the parabola having the focal length f2.

14. The reflector as claimed in claim 13, wherein the diffusion deflection angle of light reflected from each of the intermediate regions is so selected as to be gradually changed from the diffusion deflection angle of light reflected from the lower region thereof to the diffusion deflection angle of light reflected from the upper prolongation region thereof.

15. The reflector according to claim 10, wherein the oblique cut line forming reflecting surface elements and the horizontal cut line forming reflecting surface elements extend above the lines of intersection between the reflecting surface and a horizontal surface which lies 15 mm above the optical axis of the reflector.

16. The reflector as claimed in claim 15, wherein an oblique distribution pattern is formed along the oblique cut line by light reflected from the lower regions, while a substantially horizontal distribution pattern is formed by light reflected from the upper prolongation regions in such a manner that the substantially horizontal distribution pattern is located below the oblique distribution pattern, and extending substantially horizontally.

17. The reflector as claimed in claim 16, wherein an intermediate region is provided between each of the lower regions and each of the upper prolongation regions so as to form an intermediate distribution pattern between the oblique distribution pattern and the substantially horizontal distribution pattern.

18. The reflector as claimed in claim 17, wherein the diffusion deflection angle of light reflected from each of the intermediate regions is so selected as to be gradually changed from the diffusion deflection angle of light deflection angle of light reflected from the upper prolongation region thereof.

* * * * *